US011279451B2

(12) United States Patent
Norton

(10) Patent No.: US 11,279,451 B2
(45) Date of Patent: Mar. 22, 2022

(54) COLLAPSIBLE WATER VESSEL

(71) Applicant: Dan A. Norton, Conway, SC (US)

(72) Inventor: Dan A. Norton, Conway, SC (US)

( * ) Notice: Subject to any disclaimer, the term of this patent is extended or adjusted under 35 U.S.C. 154(b) by 125 days.

(21) Appl. No.: 16/874,772

(22) Filed: May 15, 2020

(65) Prior Publication Data

US 2020/0361577 A1 Nov. 19, 2020

Related U.S. Application Data

(60) Provisional application No. 62/848,185, filed on May 15, 2019.

(51) Int. Cl.

| | |
|---|---|
| ***B63B 34/23*** | (2020.01) |
| ***B63B 73/40*** | (2020.01) |
| ***B63B 3/16*** | (2006.01) |
| ***B63B 73/20*** | (2020.01) |
| ***B63B 3/14*** | (2006.01) |

(52) U.S. Cl.

CPC ..... *B63B 34/23* (2020.02); *B63B 3/16* (2013.01); *B63B 73/20* (2020.01); *B63B 73/40* (2020.01); *B63B 2003/145* (2013.01)

(58) Field of Classification Search

CPC ..... B63B 73/20; B63B 3/16; B63B 34/26; B63B 34/23; B63B 73/40; B63B 3/18; B63B 2003/145

USPC ..... 114/352, 353, 354

See application file for complete search history.

(56) References Cited

U.S. PATENT DOCUMENTS

| | | | | |
|---|---|---|---|---|
| 4,057,865 A * | 11/1977 | Trautwein | B63B 34/23 | 114/347 |
| 4,274,170 A * | 6/1981 | Simpson | B63B 34/23 | 114/347 |
| 4,841,899 A * | 6/1989 | Fleckles | B63B 34/23 | 114/347 |
| 6,263,827 B1 * | 7/2001 | Szigeti | B63B 34/23 | 114/354 |
| 7,568,444 B2 * | 8/2009 | Espeseth | B63B 34/23 | 114/347 |

* cited by examiner

*Primary Examiner* — Daniel V Venne

(74) *Attorney, Agent, or Firm* — Burr & Forman LLP; Douglas L. Lineberry

(57) ABSTRACT

A water vessel that may be assembled from a single piece of material via a fold and lever/clamp system that allows a user to assemble, use, and later disassemble the vessel into a packed form as well as assemble the vessel from the packed form.

17 Claims, 16 Drawing Sheets

COLLAPSIBLE WATER VESSEL

BACKGROUND OF THE INVENTION

1) Field of the Invention

The present disclosure relates to a water vessel that may be assembled from a single piece of material via a fold and clamp system that allows a user to assemble, use, and later disassemble the vessel and methods of assembling the vessel.

2) Description of Related Art

Outdoor equipment, whether a bicycle, boat, parasail, etc., is quite enjoyable but often necessitates a storage space, which may be lacking in urban dwellings or small homes. Indeed, some outdoor activities require more time retrieving and unpacking the equipment than the actual activity actually requires. Accordingly, it is an object of the present invention to provide a collapsible water vessel assembled from a single sheet of material in order to allow a user to form the vessel then later disassemble it after use for convenient storage.

SUMMARY OF THE INVENTION

The above objectives are accomplished according to the present invention by providing in a first embodiment a reversibly collapsible water vessel. The vessel may include a single piece hull with a plurality of fold lines defined in the single piece hull. The plurality of fold lines allow the single-piece hull to fold along the plurality of fold lines to define a vessel shape. The vessel may also include at least one clamp and at least one clamp anchor and a single-piece seat assembly. Further, the vessel may have no open seams. Yet still, at least one Z fold forming the reversibly collapsible water vessel. Yet further, the vessel may have a positionable skeg. Still yet, when disassembled, the reversibly collapsible water vessel forms a packed form by folding the single-piece hull along the plurality of folds lines to create a stack of folds enclosing at least the seat assembly. Further again, the vessel includes at least one side rail. Yet again, the single-piece seat assembly folds into multiple seat configurations via at least one groove and at least one seat panel formed into the single-piece seat assembly. Still further, the vessel shape may be a kayak. Indeed, the vessel may include at least one lever and lever clip on a side of the vessel.

In an alternative embodiment, a method for forming a reversibly assembled collapsible water vessel is provided. The method may include a single piece hull with a plurality of fold lines that allow the single-piece hull to fold to define a vessel shape, having at least one clamp and at least one clamp anchor integral to the single piece hull, and providing a single-piece seat assembly. Still further, at least one lever and lever clip may be included a side of the vessel. Again, folding the single piece hull does not form an open seam in the vessel. Yet again, the method may include forming at least one Z fold to assemble the vessel. Again yet, the method may include adding a positionable skeg on the single piece hull. Still yet, the reversibly collapsible water vessel may be converted into a packed form via folding the single-piece hull along the plurality of folds lines to create a stack of folds enclosing at least the seat assembly. The may also include at least one side rail. Further, the method may form the single-piece seat assembly to fold into multiple seat configurations via at least one groove and at least one seat panel formed into the single-piece seat assembly. Further yet, the method may include folding along the fold lines forms the vessel shape into a kayak.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
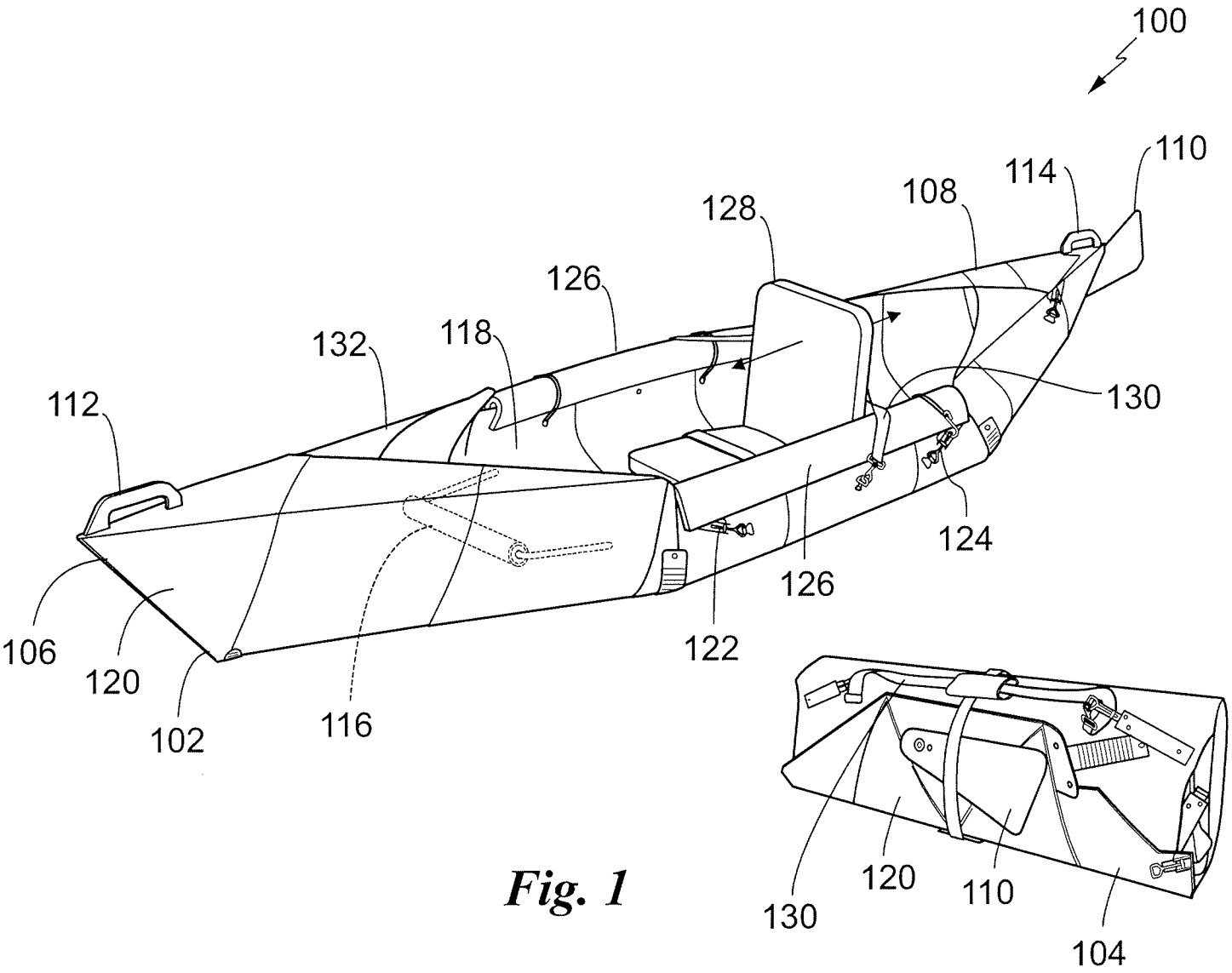
FIG. 1 shows a water vessel of the current disclosure in its assembled and packed forms.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

FIG. 1 shows a collapsible water vessel 100 in assembled form 102 and packed form 104. One of the novel features of the current disclosure is a highly efficient design wherein packed form 104 contains no extraneous pieces, meaning all parts of packed form 104 are utilized to unpack and assemble collapsible water vessel 100. Further, single piece hull 120 is made from materials having sufficient rigidity such that no internal supports, struts, ribs, supports, etc., are necessary to maintain the shape and water-tight integrity of vessel 100.

As FIG. 1 shows, collapsible water vessel 100 may include bow 106 and stern 108. Stern 108 may have a retractable fin or skeg 110 affixed to stern 108 to help guide vessel 100 when in use. Vessel 100 may also include bow handle 112 and stern handle 114 to assist with carrying vessel 100 when assembled. Vessel 100 may also include a footrest 116 disposed on vessel interior 118 of single-piece hull 120 as well as opposing assembly first lever lock 122 and second lever lock 124, with opposite side first lever lock 122 and second lever lock 124 not shown. Engagement of the levers on vessel 100 may be accomplished via various mechanisms such as clips to hold the levers, clamps designed to secure one end of the lever, catches, known to those of skill in the art, affixed to the hull to secure an end of the levers, etc. Vessel 100 may also include foam sponsons 126, which serve as side rails 600, see. FIG. 6, and a seat assembly 128. Vessel 100 may also include port side 130 and starboard side 132.

Vessel hull 120 may be made from high density polyethylene with carbon fiber reinforcements. Other materials may include, but are not limited to cross-linked polyethylene (PEX), low-density polyethylene (LDPE), linear low-density polyethylene (LLDPE), medium-density polyethylene (MDPE), polyethylene (PE), as well as combinations of the above. The current disclosure provides the portability and storage efficiency of an inflatable kayak with the durability of a hard-shell kayak. The TUCKTEC® Folding Kayak provides a solid hard shell kayak that folds up to stow anywhere and sets up in about two (2) minutes. Further, while vessel 100 is shown in the form of a kayak, the current disclosure is not so limited and various types/shapes of water going vessels may be crafted using the current disclosures novel one-piece hull design such as canoes, rafts, dugouts, gondolas, creek boats, downriders, play boats, etc.

Figure 2:
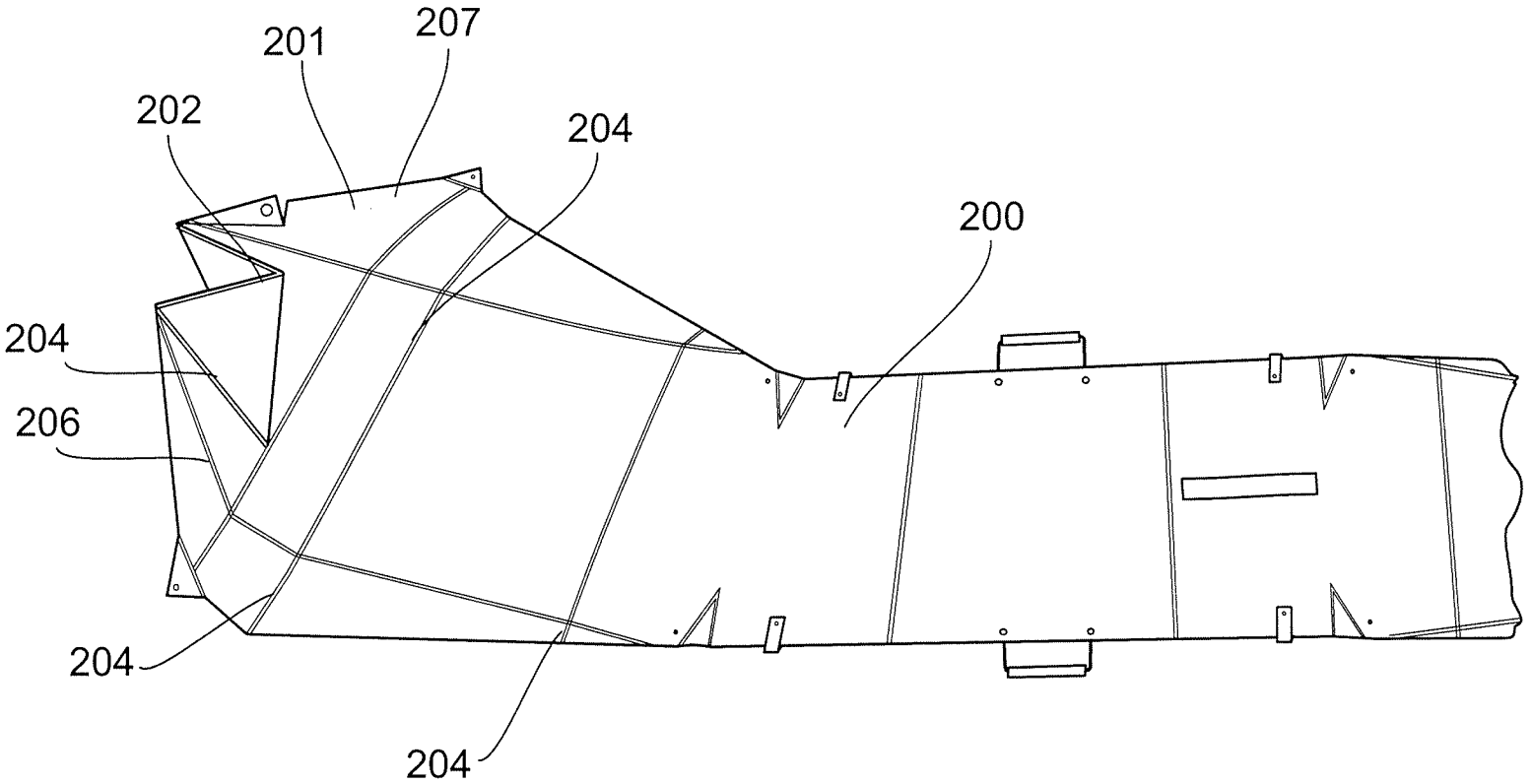
FIG. 2 shows the beginning assembly stages of a vessel of the current disclosure.

To assemble vessel 100 one may begin with the vessel in packed form 104. First, one would remove carrying strap/seat support 130. Then one unrolls single-piece hull 120 into flat configuration 200, see FIG. 2. Vessel 100 may be of a single continuous vessel body sheet comprised of plastic, synthetics, foldable metal, nonwovens, combinations of the above or other materials as known in the art. Vessel 100 may include pre-stressed folding lines 204, these lines may be formed by creasing or otherwise forming linear paths in single piece hull 120 along which folding and unfolding may occur—the lines may be made from scoring, folding bending, heat treatment, plate bending, etc. as known to those of skill in the art—see FIG. 2, as well as clamps 203 to enable the user to assemble and disassemble the craft. One key factor to the current disclosure is the nature of single piece hull 120 with its predefined folding lines 204. The pattern of folding lines 204 defined within hull 120 determine the shape of vessel 100 and allow for repeated assembly and disassembly of vessel 100. Assembly may be accomplished via manipulating the single sheet body of vessel 100 along folding lines 204 in order to configure vessel 100. All fold lines 204 may be reinforced, and stress folds may be reinforced with an additional layer of HDPE laced with carbon fibers to add further strength, such as reinforced with carbon-fiber straps.

Figure 3:
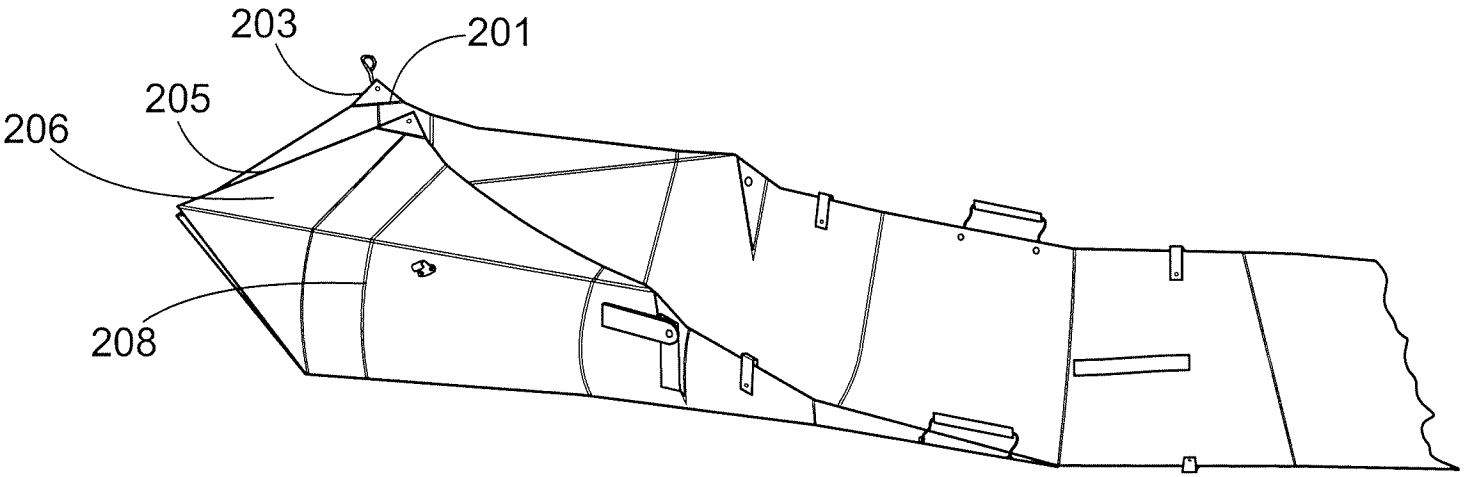
FIG. 3 shows assembly of one end of a vessel of the current disclosure.
Figure 4:
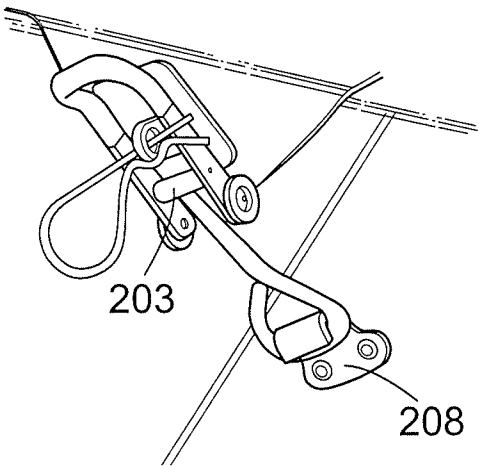
FIG. 4 shows one embodiment of a clamp that may be used with a vessel of the current disclosure.

After unrolling hull 120, one may start from either end of vessel 100. One takes bow pointed lateral section 201 or stern pointed lateral section 900, see FIG. 10, makes certain clamp 203 is in an open position, and ensures that bow hull pointed panel 202 (or stern hull pointed panel 205, see FIG. 11, depending on which end of the vessel the user begins assembly) is depressed "inward" toward the center of unrolled single-piece hull 120 and points toward the interior of vessel 100. One then folds one piece hull 120 so that first flap 207 overlaps second flap 206 and then engages open clamp 203 with clamp base 208 to secure clamp 203 and form an end Z fold 205, see FIG. 3. FIG. 4 shows an enlarged view of a clamp that may be used with the current disclosure. The above process is then repeated at the opposite end of vessel 100 to form the other end of vessel 100.

Figure 5B:
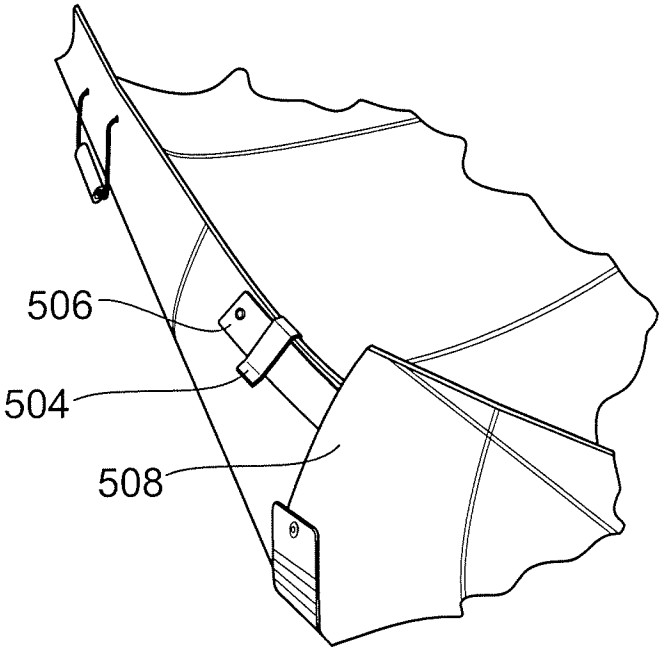
FIG. 5B shows a lever and clip of the current disclosure engaged with one another.
Figure 5A:
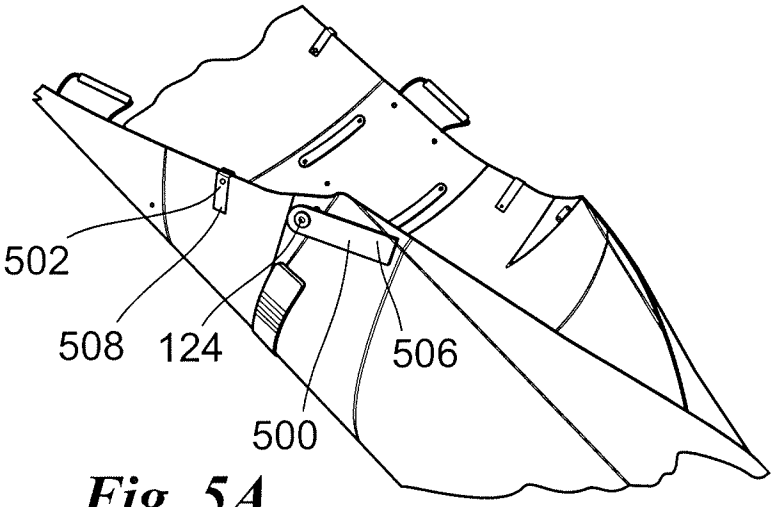
FIG. 5A shows assembly of one side of a vessel of the current disclosure.
Figure 5C:
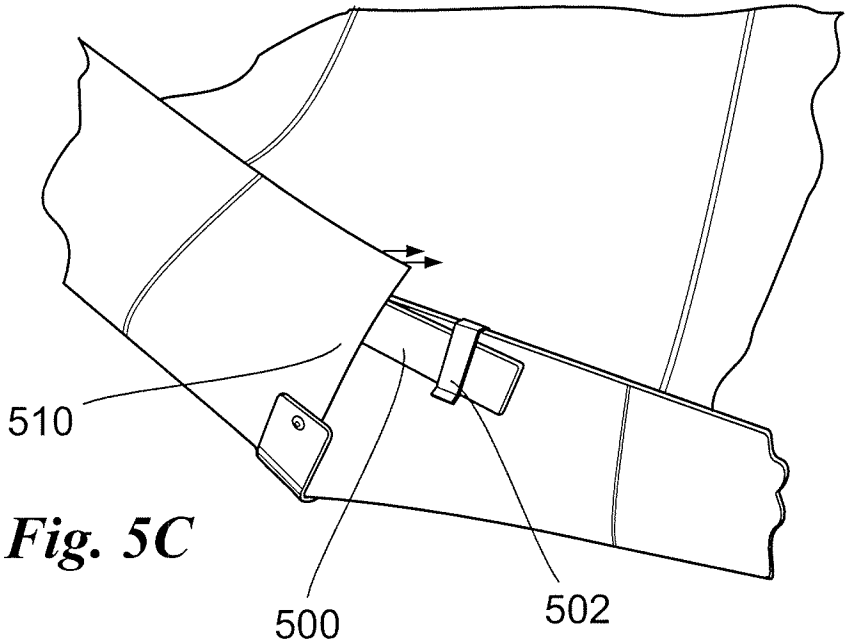
FIG. 5C shows further assembly of a side of a vessel of the current disclosure.
Figure 5D:
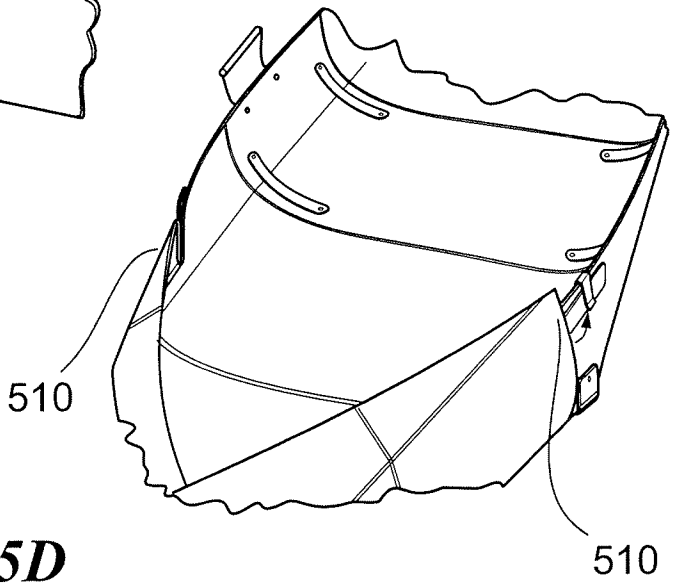
FIG. 5D shows assembly of the opposing side of a vessel of the current disclosure.
Figure 5E:
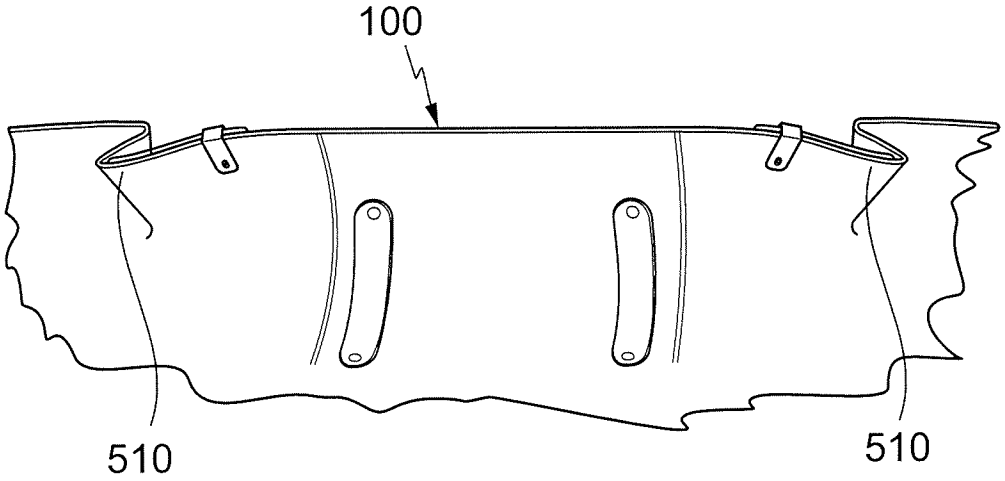
FIG. 5E shows final assembly of the opposing side of a vessel of the current disclosure.

Once both ends of vessel 100 are assembled, one then proceeds to activate lever locks 122 and 124 to form the "cockpit" of vessel 100. With respect to FIG. 5A, one proceeds to take lever 500 and move it approximately 180 degrees such that lever 500 goes from pointing at one end of vessel 100 to the opposite end by rotating along with lever flange 504 so that lever end 506 may then be moved up into clip recess 508 to secure lever end 506 within lever clip 502. In an alternative embodiment, lever 500 may be replaced with a side clamp 1108, see FIGS. 11A and 11B, wherein side clamp 1108 affixes to side clamp anchor 1110 to form the sides of the vessel. FIG. 5B shows lever 500 engaged with lever clip 502 forming yet another "Z" fold via side fold 510. At this point, one proceeds to secure the opposite lever to form yet another side fold 510 opposite the previously formed side fold 510 so that one end of the cockpit is formed. FIG. 5C shows the opposing lever 500 secured within lever clip 502 forming another "Z" fold via side fold 510 on the opposite side of vessel 100. One then proceeds to fasten the remaining two levers 500 by forming two more "Z" folds via forming two more side seams 510, see FIG. 5D. FIG. 5E shows two completed side folds 510 formed adjacent "Z" folds on one side of vessel 100. As FIGS. 5A-5E illustrate, single piece hull 120 is a solid single sheet and all folds go "up" and "over" themselves in a "Z" pattern/configuration so that there are no open seams to leak or that require sealant before use.

Figure 6A:
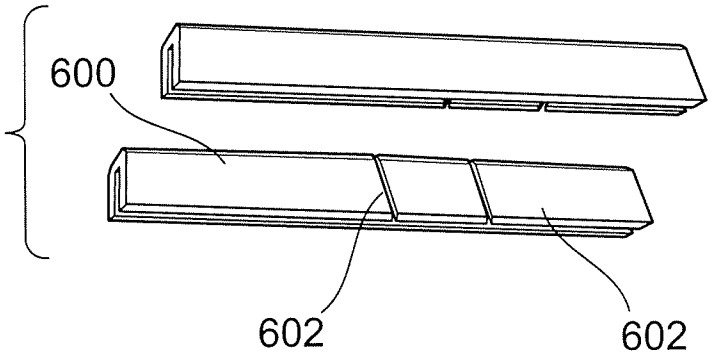
FIG. 6A shows one embodiment of side rails that may be used with the current disclosure.
Figure 6B:
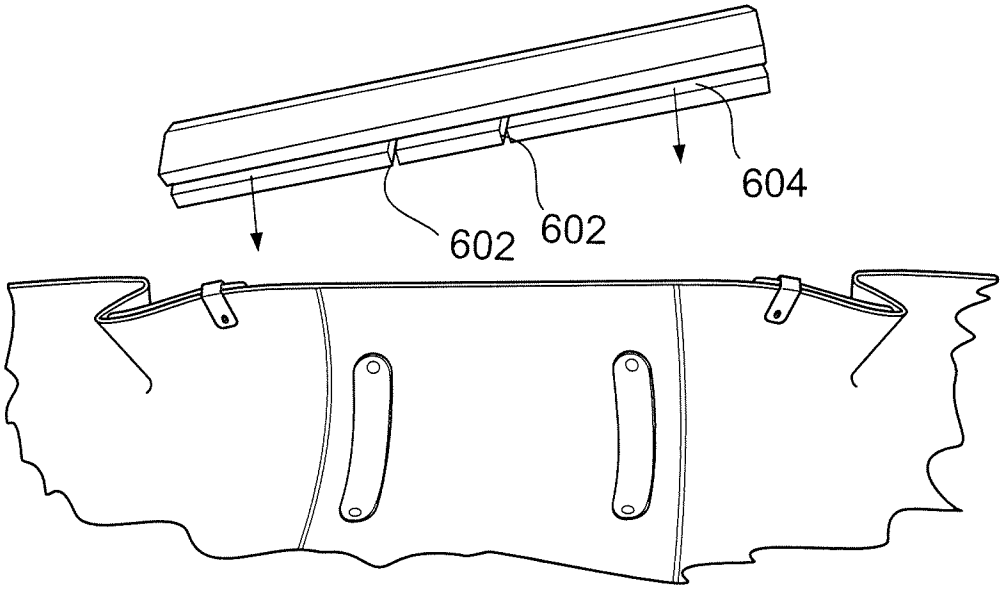
FIG. 6B shows a bottom view of one embodiment of side rails that may be used with the current disclosure.
Figure 6C:
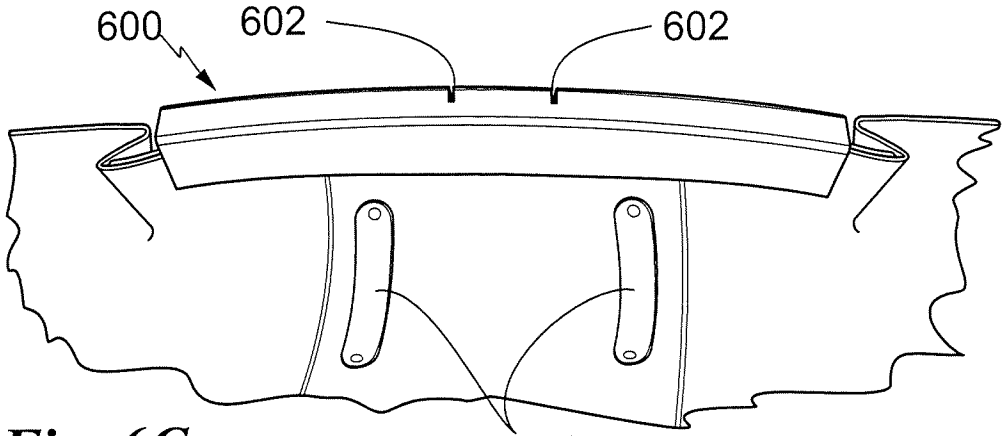
FIG. 6C shows a side rail installed on a vessel of the current disclosure.
Figure 6D:
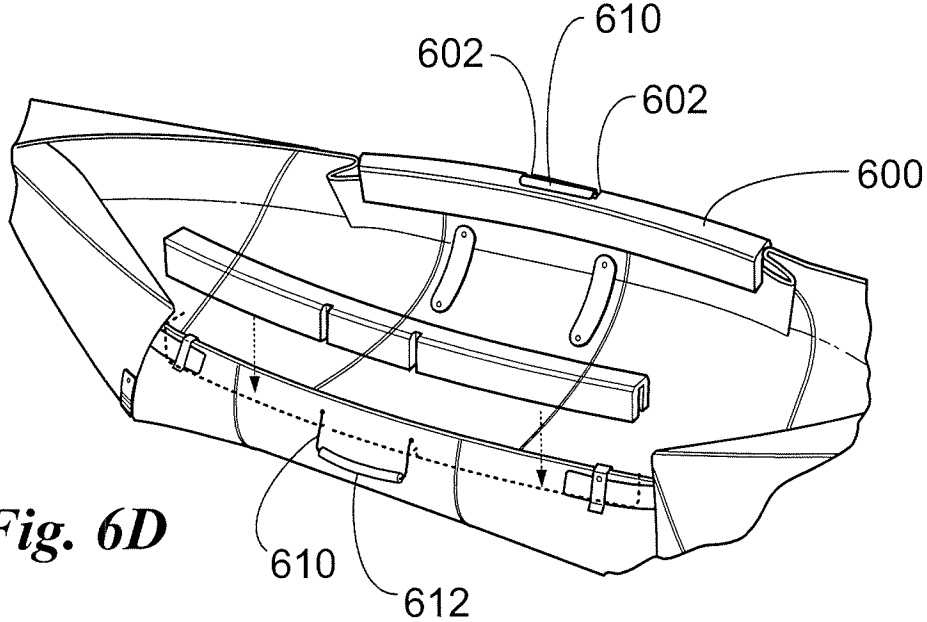
FIG. 6D shows assembly of an opposing side rail on a vessel of the current disclosure.

FIG. 6A shows a front and back view of side rails 600 that are then installed over the "Z" folds formed by side folds 510. Side rails 600 may be formed from marine grade foam such as marine polyurethane products including flexible polyurethane foam (FPF), rigid polyurethane foam (RPF), thermoplastic polyurethane (TPU) and FR-7100 multi-use foam. At this stage, one takes side rail 600, which has side grooves 602, see FIG. 6A, and bottom engagement groove 604, see FIG. 6B, and slides bottom engagement groove over side folds 510 and over both conjoined lever 500 and lever clip 502 with side grooves 602 facing away from cockpit 606, see FIG. 6C. Vessel 100 may also include reinforcement straps 608, which provide additional strength to areas of the vessel hull that experience pressure/torsion forces during assembly, disassembly, use, etc., FIG. 6D shows side handle 610 engaged with side grooves 602 via frictional engagement wherein side handle 610 is pulled into the grooves with gripping element 612 of side handle 610 remaining free of side rail 600 and side grooves 602. Handles 610 may be made from nylon, rope, or other materials as known to those of skill in the art and may be formed integrally with hull 120.

Figure 7A:
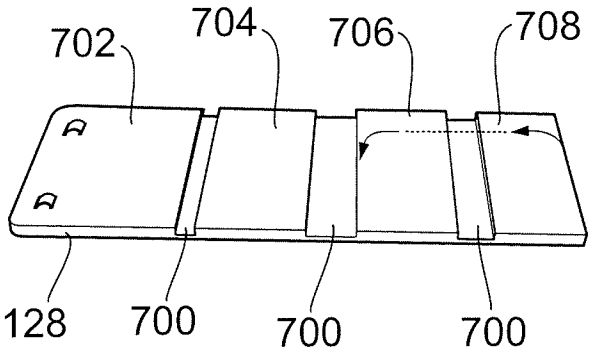
FIG. 7A shows a seat/back of the current disclosure laid open.
Figure 7C:
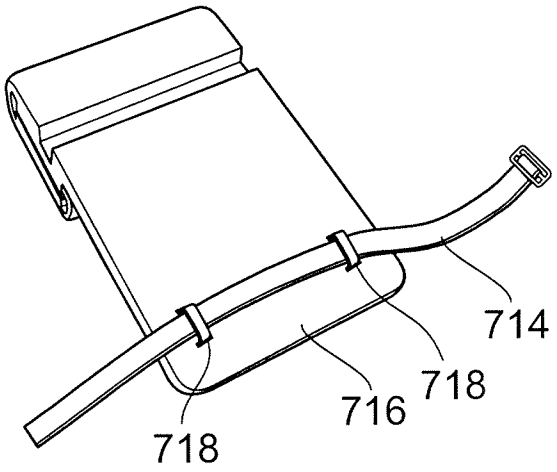
FIG. 7C shows affixing a seat back strap to a seat/back of the current disclosure.
Figure 7B:
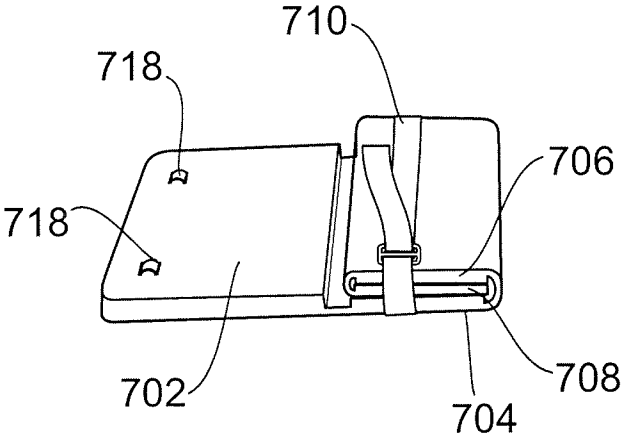
FIG. 7B shows a seat/back of the current disclosure with the seat assembled via folding sections upon one another.

FIG. 7A shows seat assembly 128 with seat grooves 700 and seat back 702, lower seat panel 704, upper seat panel 706 and middle seat panel 708. While three seat grooves 700 and three seat panel sections 702, 704, and 706 are shown, the current disclosure is not so limited and 1, 2, 4, 5, 6, 7, or more seat grooves are considered disclosed herein. FIG. 7B shows upper seat panel 706 folded atop middle seat panel 708 and lower seat panel 704 via folding the three at their respective seat grooves 700. Seat panel strap 710, which may be a female VELCRO® strap, or other male/female engagement combination, is used to secure the three seat panels together to form seat cushion 712. FIG. 7C shows seat assembly 128 with seat back strap 714 affixed to seat back 716. Affixment may be accomplished via VELCRO®, male/female, frictional, or other types of engagement as known to those of skill in the art. In one embodiment, seat back 716 may include integrated loops 718 or other mechanisms for surrounding and holding seat back strap 714 in position.

Figure 7E:
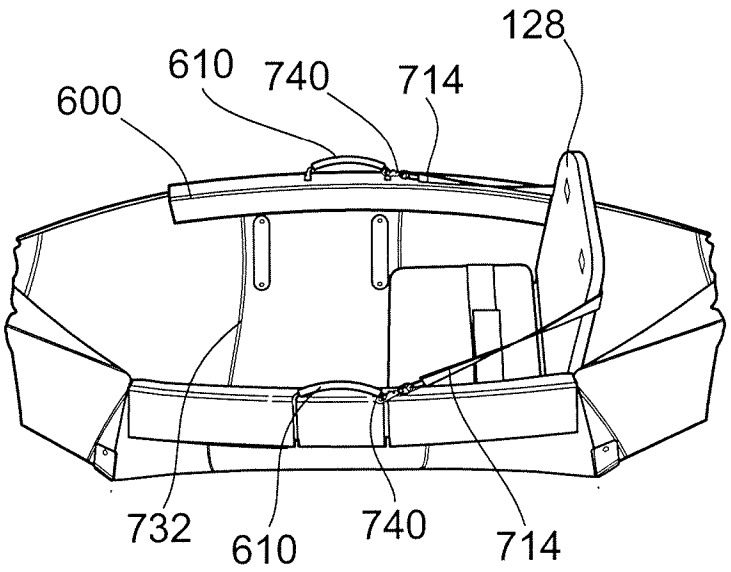
FIG. 7E shows an installed seat/back of the current disclosure affixed to handles of a vessel of the current disclosure.
Figure 7D:
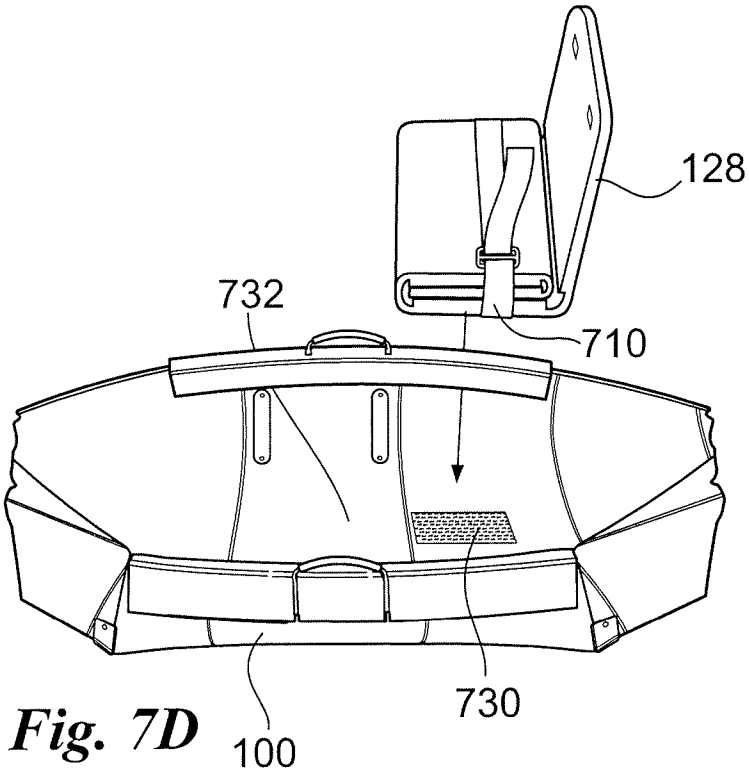
FIG. 7D shows installing a seat/back of the current disclosure into a vessel of the current disclosure.

FIG. 7D shows seat assembly 128 being inserted into vessel 100. Seat panel strap 710, via male/female, frictional engagement, etc., as known to those of skill in the art, engages with skid pad 730 affixed to inner hull 732, which secures seat assembly in place with respect to vessel 100 and single piece hull 120. FIG. 7E shows seat assembly 128 fully installed with seat back strap 714 affixed to both side handles 610 at seat back strap ends 740. Affixment may be made via carabineers, hook and loop fasteners, spring-biased clips, frictional engagement, etc., as known to those of skill in the art. Seat back strap 714 thereby secures seat assembly 128 in place as well as provides back support to the user during use. FIG. 7E shows that seat assembly 128 may be configured in multiple ways, such as extending lower seat panel 704 toward stern 108 of vessel 100 by simply not folding lower seat panel 704 underneath middle seat panel 708. This allows the user to sit lower in vessel 100, forming a lower center of gravity and providing enhanced stability during use.

Figure 8A:
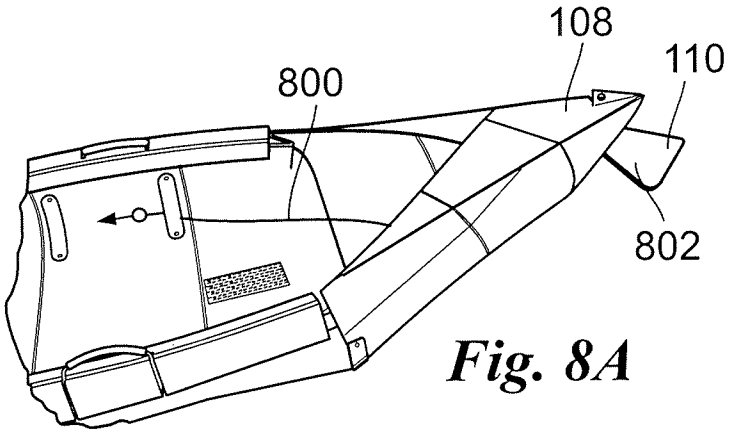
FIG. 8A shows a skeg of the current disclosure in its downward/water engaging position.
Figure 8B:
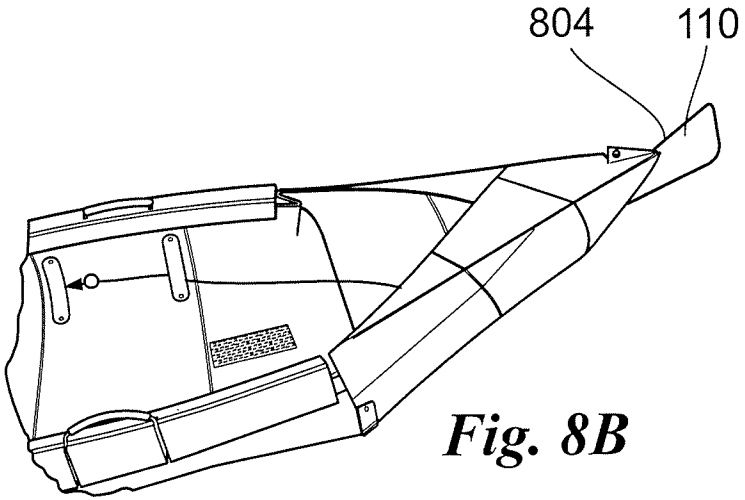
FIG. 8B shows a skeg of the current disclosure in its upward/unengaged position.
Figure 7F:
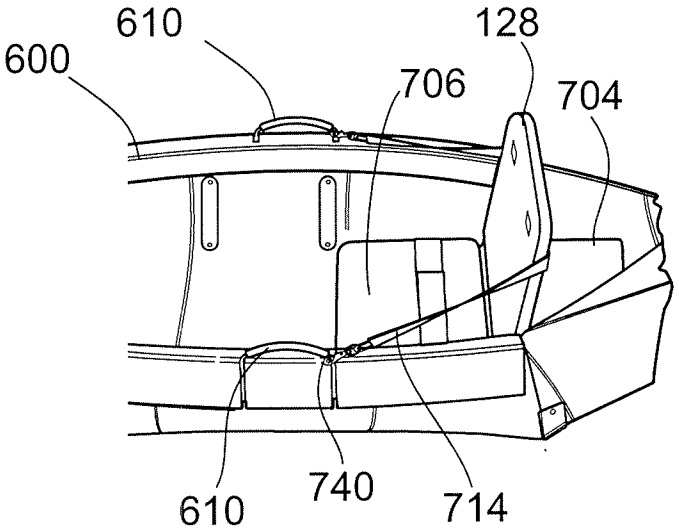
FIG. 7F shows an alternate installation configuration for a seat/back of the current disclosure.

FIG. 8A shows retractable tracking fin/skeg 110 and skeg control cord 800 with skeg 110 in down position 802. Pulling skeg control cord 800 "forward" or in the direction of bow 106, lifts skeg 110 upward. Pulling skeg control cord 800 toward stern 108 allows skeg 110 to move downward and reengage the water. FIG. 8B shows skeg 110 in up position 804.

Figure 9A:
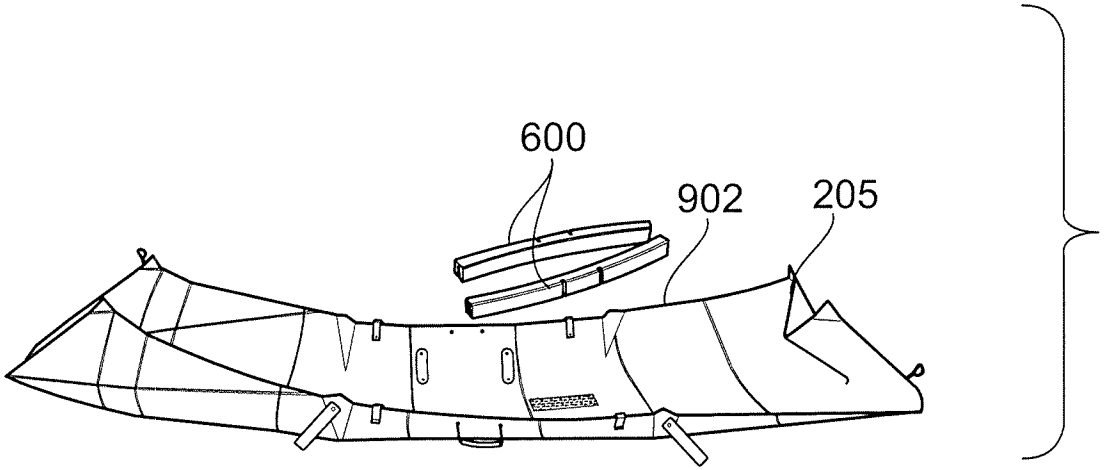
FIG. 9A shows the initial stages of packing a disassembled vessel of the current disclosure.
Figure 9B:
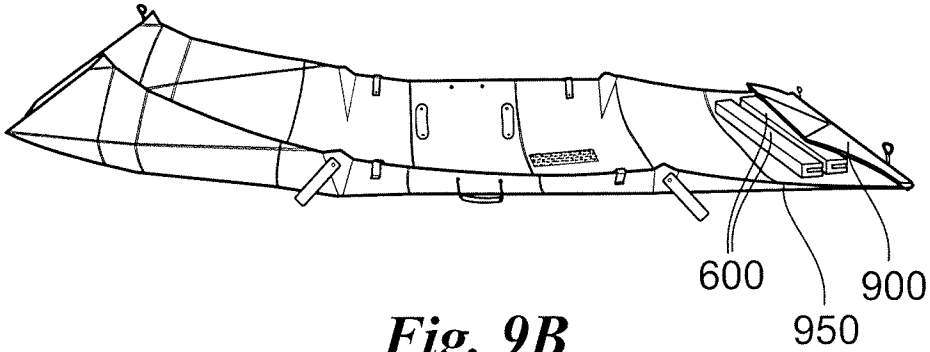
FIG. 9B shows folding a disassembled vessel over handrails to contain same.
Figure 9D:
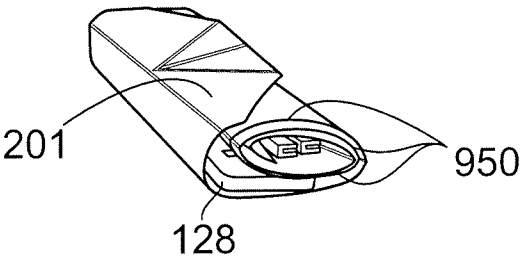
FIG. 9D shows a vessel of the current disclosure fully folded upon itself containing rails and seat/back within the stacked folds.
Figure 9C:
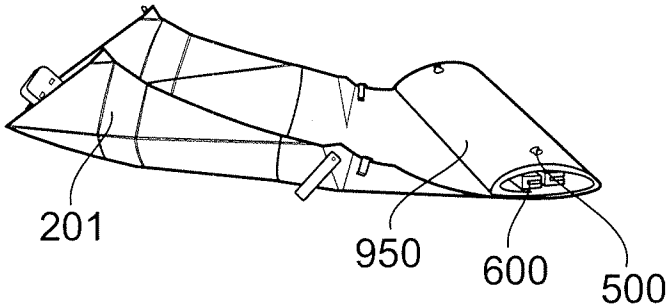
FIG. 9C shows folding lateral sections of a vessel of the current disclosure atop one another to compact the vessel.
Figure 9E:
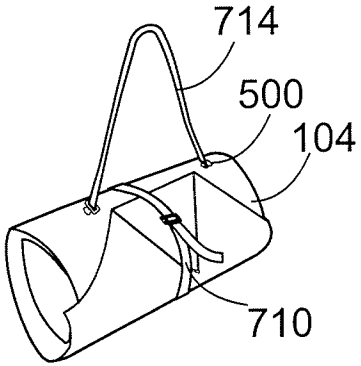
FIG. 9E shows a fully disassembled vessel in its packed form.

To disassemble vessel 100, one removes seat assembly 128 and undoes seat panel strap 710, releases side handles 610 from seat grooves 700 (or releases clamps depending on which embodiment is present), removes side rails 600, then unlatches levers 500 from lever clips 502. The order of releasing the levers/clamps does not impact disassembly. Then one releases clamps 203 from clamp bases 208. One may then place the disassembled seat assembly 128 onto hull 120. Starting at stern 108, one proceeds to store side rails 600 adjacent stern 108 and lifts stern lateral section 205, positioning skeg 110 toward starboard side 902. One then folds first stern panel 900 over rails 600 toward bow 106 atop lateral panel 950, see FIG. 9B. FIG. 9C shows vessel 100 folded further toward bow 106 with levers 500 positioned inward toward the interior of vessel 100. When one arrives at last lateral panel 950 of vessel 100, disassembled seat assembly 128 is lain flat and perpendicular to bow 106 and stern 108 atop the last lateral panel 950 and then folded under. Bow lateral section 201 is then folded atop the stacked lateral sections 950, see FIG. 9D. One then simply places the "rolled" "stacked" or "folded" vessel 100 atop seat panel strap 710, which wraps around the "rolled" "stacked" or "folded" vessel 100, and secures to itself via VELCRO®, male/female engagement, or other means as known to those of skill in the art. One then affixes seat back strap 714 to levers 500 to create packed form 104, see FIG. 9E.

Figure 10:
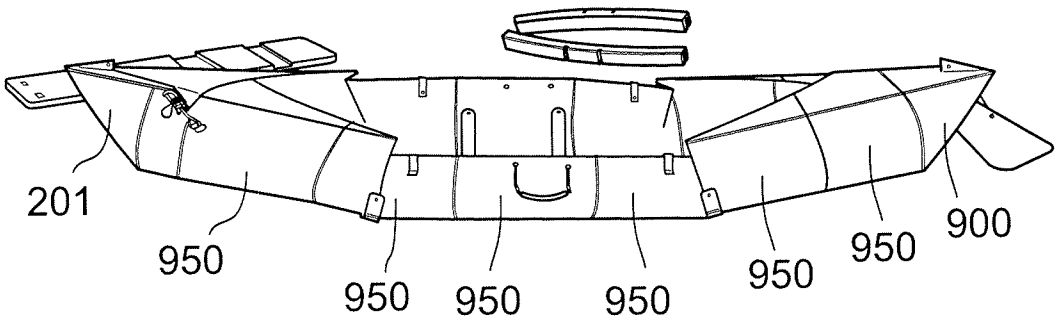
FIG. 10 shows a side view of an assembled vessel of the current disclosure and the foldable panels comprising the vessel structure.
Figure 11A:
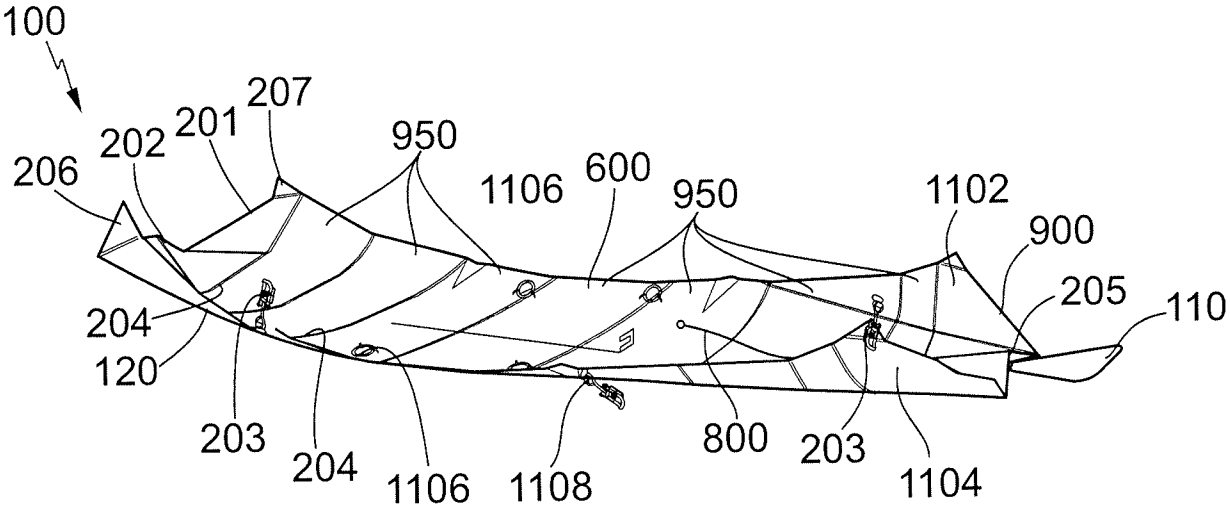
FIG. 11A shows a flat view of a disassembled vessel of the current disclosure displaying foldable panels and fold lines comprising the vessel structure.
Figure 11B:
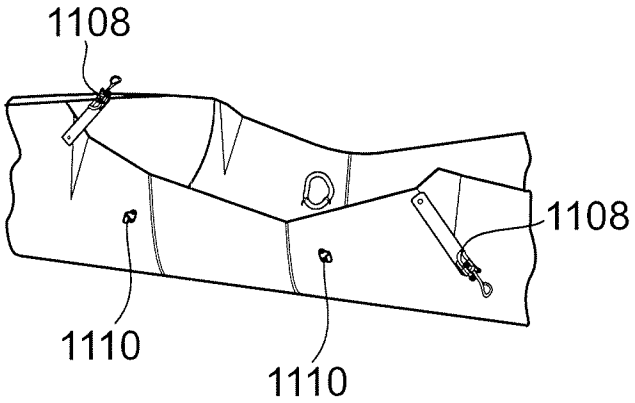
FIG. 11B shows an alternative embodiment for assembling a vessel side of the current disclosure employing side clamps and side clamp anchors.

FIG. 10 shows a side view of assembled vessel 100 and lateral panels 950. While six (6) lateral panels 950 are show, the current disclosure is not so limited and more or less lateral panels 950, such as 4, 5, 7, 8, 9, or more or less panels are envisioned within the scope of the current disclosure. The same holds true for the bow and stern panels referenced herein.

FIG. 11 shows a disassembled hull 120 of the current disclosure displaying lateral fold sections 950, folding lines 204, bow pointed lateral section 201, stern pointed lateral section 205, rails 600, clamps 203, skeg 110, stern first flap 1102, stern second flap 1104. Vessel 100 may also include side rail 600 securing loops 1106, which overlap rail 600 and fasten to lever 500 and/or lever clip 502.

Figure 12A:
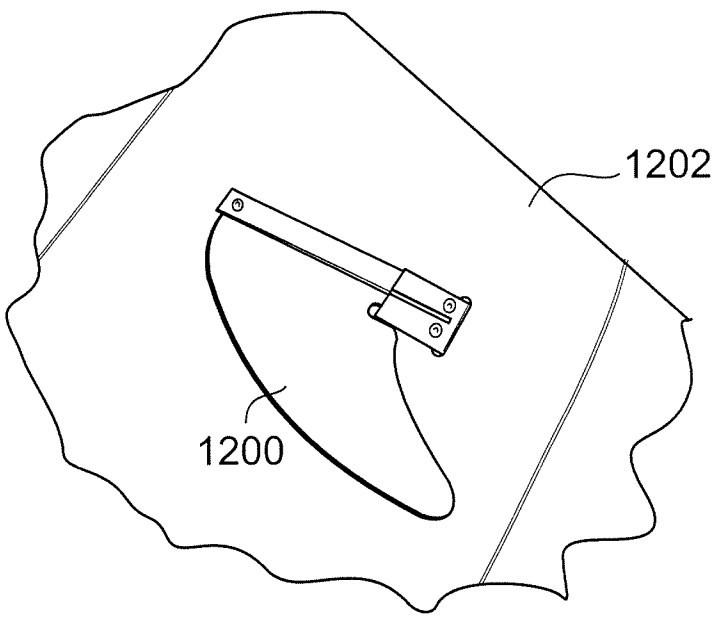
FIG. 12A shows a pop-up fin that may be employed with the current disclosure via installation on hull bottom.
Figure 12B:
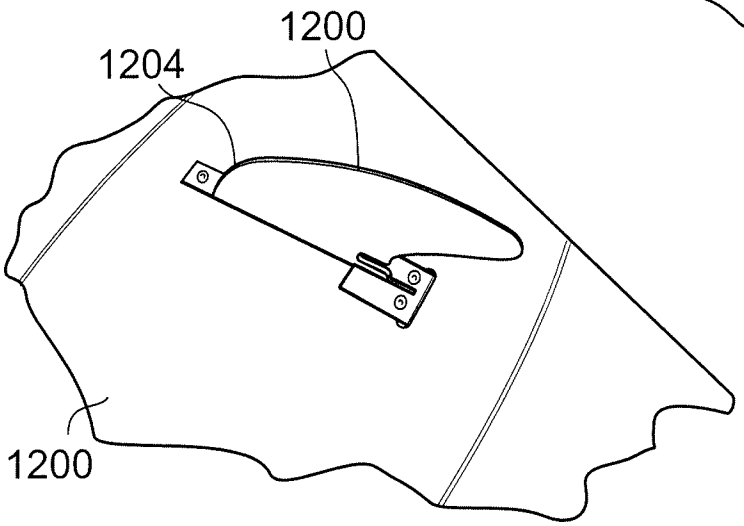
FIG. 12B shows the pop-up fin in its deployed position.
Figure 13A:
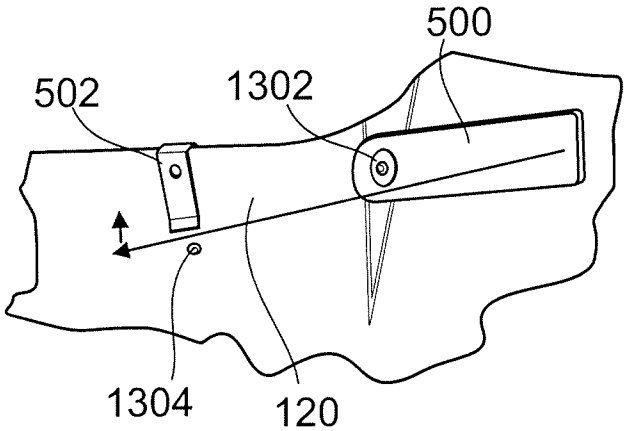
FIG. 13A shows a close-up views of lever and lever clip unengaged.
Figure 13B:
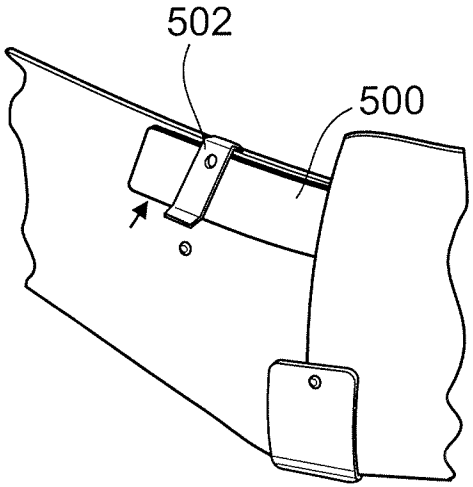
FIG. 13B shows a close-up view of lever and lever clip engaged.

FIG. 12A shows a pop-up fin 1200, in undeployed position 1201, that may be employed with the current disclosure via installation on hull bottom 1202. FIG. 12B shows the pop-up fin 1200 in deployed position 1204. FIGS. 13A and 13B show close-up views of lever 500 and lever clip 502 in unengaged, FIG. 13A, and engaged positions, see FIG. 13B. In one embodiment, affixing device 1302 may attach lever 500 to hull 120 and securing attachment 1304 may affix lever clip 502 to hull 120.

As the FIGS. demonstrate, the vessel may be held together via clamps and levers. However, other fasteners, such as hook and loop, gecko feet, male/female engagement, releasable adhesives, etc., as known to those of skill in the art, are envisioned and considered within the scope of this disclosure. The current disclosure provides a vessel capable of repeated assemblies and disassembles while maintaining hull structural integrity and forming a vessel wherein the full is supported solely by the material that forms the hull of the craft, not by internal struts, framing, ribs, etc.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A reversibly collapsible water vessel comprising:
a single piece hull comprising a plurality of fold lines defined in the single piece hull, wherein the plurality of fold lines allows the single-piece hull to fold along the plurality of fold lines to define a vessel shape;
at least one clamp and at least one clamp anchor; and
a single-piece seat assembly.

2. The reversibly collapsible water vessel of claim 1 further comprising no open seams.

3. The reversibly collapsible water vessel of claim 1 further comprising at least one Z fold to assemble the reversibly collapsible water vessel.

4. The reversibly collapsible water vessel of claim 1 further comprising a positionable skeg.

5. The reversibly collapsible water vessel of claim 1 wherein when disassembled the reversibly collapsible water vessel forms a packed form via folding the single-piece hull along the plurality of folds lines to create a stack of folds.

6. The reversibly collapsible water vessel of claim 1 further comprising at least one side rail.

7. The reversibly collapsible water vessel of claim 1, wherein the single-piece seat assembly folds into multiple seat configurations via at least one groove and at least one seat panel formed into the single-piece seat assembly.

8. The reversibly collapsible water vessel of claim 1, wherein the vessel shape comprises a kayak.

9. The reversibly collapsible water vessel of claim 1, further comprising at least one lever and lever clip on at least one side of the vessel.

10. A method for forming a reversibly assembled collapsible water vessel comprising:
providing a single piece hull comprising a plurality of fold lines, wherein the fold lines allow the single-piece hull to fold along the fold lines to define a vessel shape;
providing at least one clamp and at least one clamp anchor affixed to the single piece hull; and
providing a single-piece seat assembly.

11. The method of claim 10, further comprising wherein folding the single piece hull does not form an open seam in the vessel.

12. The method of claim 10, further comprising forming at least one Z fold to assemble the reversibly collapsible water vessel.

13. The method of claim 10, further comprising including a positionable skeg on the single piece hull.

14. The method of claim 10, further comprising converting the reversibly collapsible water vessel into a packed form via folding the single-piece hull along the plurality of folds lines to create a stack of folds.

15. The method of claim 10, further comprising including at least one side rail.

16. The method of claim 10, further comprising forming the single-piece seat assembly to fold into multiple seat configurations via at least one groove and at least one seat panel formed into the single-piece seat assembly.

17. The method of claim 10, further comprising wherein folding along the fold lines forms the vessel shape into a kayak.

* * * * *